US010400386B2

(12) United States Patent
Heinz et al.

(10) Patent No.: US 10,400,386 B2
(45) Date of Patent: Sep. 3, 2019

(54) METHOD AND DEVICE FOR THE TRANSPORT AND/OR SPREADING-OUT OF LAUNDRY ITEMS HUNG ON CLAMPS

(71) Applicant: Herbert Kannegiesser GmbH, Vlotho (DE)

(72) Inventors: Engelbert Heinz, Vlotho (DE); Andreas Olivieri, Minden (DE)

(73) Assignee: Herbert Kannegiesser GmbH, Vlotho (DE)

( * ) Notice: Subject to any disclaimer, the term of this patent is extended or adjusted under 35 U.S.C. 154(b) by 0 days.

(21) Appl. No.: 15/881,908

(22) Filed: Jan. 29, 2018

(65) Prior Publication Data

US 2018/0223469 A1 Aug. 9, 2018

(30) Foreign Application Priority Data

Feb. 8, 2017 (DE) ..... 10 2017 001 145

(51) Int. Cl.
*D06F 67/04* (2006.01)

(52) U.S. Cl.
CPC ..... *D06F 67/04* (2013.01)

(58) Field of Classification Search
CPC ..... D06F 67/04; D06F 69/02; D06F 95/00; D06F 95/008; D06F 71/40; B65G 47/36; B65G 17/20; B65G 17/32; B65H 5/14; B07C 3/085; B07C 3/02; B66C 1/48
See application file for complete search history.

(56) References Cited

U.S. PATENT DOCUMENTS 4,143,476 A * 3/1979 Holmes ..... D06F 67/04 38/143
4,313,269 A * 2/1982 van Rumpt ..... B65G 9/00 38/143
5,169,282 A * 12/1992 Ueda ..... D06F 67/04 38/7

(Continued)

FOREIGN PATENT DOCUMENTS

DE 3839045 A1 12/1989
DE 19703587 A1 8/1998

(Continued)

OTHER PUBLICATIONS

European Patent Office, Europaischer Recherchenbericht (serach in a related application), Jun. 1, 2018.

*Primary Examiner* — Ismael Izaguirre
(74) *Attorney, Agent, or Firm* — Laurence P. Colton; Smith Tempel Blaha LLC

(57) ABSTRACT

A method and device providing that the corners of a respective laundry item are transferred one by one from a conveyor to spreading clamps of a pair of spreading clamps at the same position in each case. The respective conveyor therefore only requires a single circulatory track. Laundry items in commercial laundries are fed by at least one conveyor to spreading clamps of an input machine. In this case, each corner delimiting a front edge of the laundry item is held by a clamp of the conveyor. The respective conveyor is usually branched, in order for the corners to be transferred at the same time to the two spreading clamps of a pair of spreading clamps. Thus, the respective conveyor must have a branched track system with appropriate switches.

8 Claims, 5 Drawing Sheets

(56) References Cited

U.S. PATENT DOCUMENTS

| | | | | |
|---|---|---|---|---|
| 8,142,129 | B2 * | 3/2012 | Sielermann | D06F 67/04 198/465.4 |
| 9,187,253 | B2 * | 11/2015 | Olivieri | D06F 67/04 |
| 2009/0266749 | A1 * | 10/2009 | Heinz | D06F 93/00 209/580 |

FOREIGN PATENT DOCUMENTS

| | | | |
|---|---|---|---|
| EP | 1213385 | A2 | 6/2002 |
| EP | 2045391 | A2 | 4/2009 |

* cited by examiner

METHOD AND DEVICE FOR THE TRANSPORT AND/OR SPREADING-OUT OF LAUNDRY ITEMS HUNG ON CLAMPS

STATEMENT OF RELATED APPLICATIONS

This application claims priority on and the benefit of German Patent Application No. 10 2017 001 145.1 having a filing date of 8 Feb. 2017.

BACKGROUND OF THE INVENTION

Technical Field

The invention relates to a method for the transport and/or spreading of laundry items hung on clamps, preferably for the purpose of transferring the laundry items to an input machine, wherein the respective laundry item hanging with adjacent corners of an edge in clamps of at least one conveyor is transferred to two spreading clamps of a spreading device of the input machine, as well as a device for the transport and/or the spreading of laundry items hanging on clamps, preferably for the purpose of transporting laundry items hanging on clamps to an input machine, with at least one conveyor, which has at least one circulating track running along its conveying section, on which can run successive clamps, each for one corner of the laundry item concerned, wherein the at least one track is led to the input machine for transferring adjacent corners of an edge of the respective laundry item to spreading clamps of at least one pair of spreading clamps of the input machine.

Prior Art

In commercial laundries, laundry items are transported by conveyers to an input machine, which spreads the laundry items and feeds them in a spread-out state to a mangle or some other laundry treatment machine. The conveyor is equipped with clamps on which the laundry items are transported to the input machine in the hanging state.

It is already well-known to transfer the laundry items from the clamps of the conveyor to spreading clamps of a spreading device of the input machine. Prior to the invention, this was done by initially hanging, preferably manually, adjacent corners of an edge of the respective laundry item in two consecutive clamps of the conveyor. The laundry item is then transported to the input machine hanging with adjacent corners on two different clamps of the conveyor. Both corners of the laundry item involved are then simultaneously transferred automatically from the respective clamp of the conveyor to two spreading clamps of a pair of spreading clamps of the spreading device of the input machine. This requires a conveyor with a conveying section that has, at least upstream of the input machine, two parallel track sections into which the two clamps holding the two corners of the laundry item can be driven by means of corresponding track switches. Such a conveyor has a relative complex conveying section with a corresponding sensor system to achieve the targeted distribution of the two clamps holding the adjacent corners of the respective laundry item into the two conveying sections arranged side by side in front of the input machine.

BRIEF SUMMARY OF THE INVENTION

The invention is based on the object of providing a method and a device which in a simple manner make it possible to achieve a reliable, automatic feeding and transfer of laundry items to spreading clamps of an input machine.

A method for achieving this object is a method for the transport and/or the spreading of laundry items hanging on clamps, preferably for the purpose of transferring the laundry items to an input machine, wherein the respective laundry item hanging with adjacent corners of an edge in clamps of at least one conveyor is transferred to two spreading clamps of a spreading device of the input machine, characterized in that, the adjacent corners of the laundry item concerned are transferred one after the other from the clamps to the two spreading clamps of the spreading device. Accordingly, the adjacent corners of an edge of the respective laundry item held by consecutive clamps of the conveyor are transferred one after the other to the spreading clamps. This can be carried out by a simplified conveyor having a conveying section with only one track and, if possible, without any track switches. This simplifies the conveyor design and results in a more reliable transfer of the corners of the laundry item from the clamps into the spreading clamps of the input machine.

The adjacent corners of the respective laundry item are preferably transferred one after the other to the spreading clamps such that the transfer of the corners of the laundry item from the clamps to the spreading clamps is conducted in a successive manner, in other words first the one corner of the edge, followed by the other corner of the same edge. In particular, the corners of the respective laundry item are transferred to the spreading clamps by successive and/or spaced-apart clamps of the conveyor following one another. The transfer procedure can then be carried out successively in a targeted manner.

One advantageous further development of the method provides for the transfer of the respective laundry item to the spreading clamps of the input machine by such successive or immediately consecutive clamps of the conveyor which hold the adjacent corners of the edge of the laundry item. This further simplifies the transfer of the respective laundry item to the spreading clamps with the input machine and can be conducted in a reliably controlled manner.

Another advantageous configuration of the method provides that the clamps which hold the adjacent corners of the edge they delimit are transferred successively or one after the other to the spreading clamps of the input machine at the same position or at least at the approximately same position. For this purpose, the two spreading clamps of each pair of spreading clamps are preferably driven one after the other to this position for the successive transfer in each case of a corner of the same laundry item from the conveyor clamps, which are driven to the position one after the other, to the spreading clamps of the same pair of spreading clamps, which have likewise been driven one after another to the same position. Due to the fact that the transfer procedure of both corners of the respective laundry item is executed at the essentially same position, the conveyor and/or the input machine can have a more simple design than was previously the case. The two adjacent corners of an edge of the respective laundry item are thus automatically transferred on a single track to the spreading clamps held ready one after the other to take over the respective corner.

With the method according to the invention, an automatic transfer is preferably executed of the two corners which delimit an edge of the laundry item when the clamps of the at least one conveyor, which each hold a single corner of the laundry item, travel past the spreading clamps of the input machine which have been brought to a transfer position, preferably at the common point of transfer. The respective corner is thus automatically transferred to the provided spreading clamp held ready as the respective spreading clamp is in each case passed by a conveyor clamp holding the laundry. The automatic transfer is preferably carried out as the respective conveyor clamp with the corner of the laundry located therein travels in an uninterrupted manner past the spreading clamp, which is provided to receive said corner and which at that moment has been brought to a standstill. The transfer can then be carried out as the conveyor continues to run without interruption. By overtaking the spreading clamp, preferably the resting spreading clamp, the continuously further transported clamp with the corner of the laundry item hanging from it is continuously driven past the respective spreading clamp. In the process, the transfer procedure is executed automatically and smoothly.

A device for achieving the aforementioned object is a device for the transport and/or the spreading of laundry items hanging on clamps, preferably for the purpose of transporting laundry items hanging on clamps to an input machine, with at least one conveyor, which has at least one circulating track running along its conveying section, on which can run successive clamps, each for one corner of the laundry item concerned, wherein the at least one track is led to the input machine for transferring adjacent corners of an edge of the respective laundry item to spreading clamps of at least one pair of spreading clamps of the input machine, characterized in that the clamps assigned one after another to the track can be driven along and/or past a respective spreading clamp of the pair of spreading clamps. In the case of this device is it provided that the clamps assigned one after another to the respective track of the conveyor are driven one after another along and/or past the respective spreading clamps of the input machine. As a result, the first corner of an edge of the laundry item and afterwards the second corner of the edge of the laundry item can be can be automatically transferred from the conveyor to the input machine on one track during the further transport of the respective clamp. Due to the single-track arrangement of this automatic transfer, the conveyor requires only one simple conveying section. It is thus not absolutely necessary to have switches in the conveying section for the automatic transfer of the adjacent corners of the respective laundry item held by the conveyor clamps to the spreading clamps of the input machine.

The device is preferably configured such that it is possible for the conveyor clamps to travel one by one along and/or past the essentially same position or point of the input machine. Here it is in particular provided that the adjacent corners of an edge of the laundry item are also moved by the clamps one by one past the spreading clamps of the input machine that are held ready at the same position, with the adjacent corners always being automatically transferable at the same position in a targeted succession to the spreading clamps of the input machine that are positioned or held ready for transfer there. The automatic and successive transfer of the two corners of an edge of a laundry item from the conveyor clamps to the spreading clamps of the input machine made at the essentially same position simplifies the design of the device and also makes the automatic transfer more reliable.

According to an advantageous possible design of the device, all conveyor clamps are equally configured as double clamps. Each of the double clamps has two spaced-apart individual clamps, which jointly clamp and hold the respective corner of the laundry item. In this way, a narrow strip of the corner is held in the double clamp in a spread-out and/or extended state between the individual clamps. This strip is driven into the respective spreading clamp during the transfer procedure. This facilitates the transfer of the respective corner of the laundry item from the conveyor clamp configured as a double clamp to the provided spreading clamp of the input machine.

The distance between the two individual clamps of each conveyor clamp configured as a double clamp is preferably greater, preferably only slightly greater, than the width of each spreading clamp of the input machine. It is therefore possible to transfer the respective corner of the laundry item from the clamp configured as a double clamp to the provided spreading clamp in that the spreading clamp can enter between the spaced-apart individual clamps of the clamp configured as a double clamp and the individual clamps at opposite sides of the spreading clamp can move past it. This results in a particularly reliable transfer of the respective corner of the laundry item from the clamp configured as a double clamp to the provided spreading clamp. This transfer can occur as the clamp configured as a double clamp travels past the spreading clamp, in other words as the spreading clamp is overtaken, as it were, by the clamp configured as a double clamp.

Provision is preferably made to run the track of the or of the respective conveyor to the input machine in such a manner that a section of the respective corner of the laundry item held, preferably stretched, between the individual claps of the respective conveyor clamp configured as a double clamp can be conveyed, in particular driven, from an open side of a clamping mouth of the respective spreading clamp into this clamping mouth. As a result, the at least one conveyor and the input machine of the device "mesh" with each other, so to speak, in that they, in particular the track of the conveyor and the spreading device of the input machine, are positioned and configured relative to one another in a mutually corresponding manner.

BRIEF DESCRIPTION OF THE DRAWINGS

A preferred exemplary embodiment of the invention is described in more detail in the following on the basis of the drawing, in which.

DETAILED DESCRIPTION OF PREFERRED EMBODIMENTS

Figure 1:
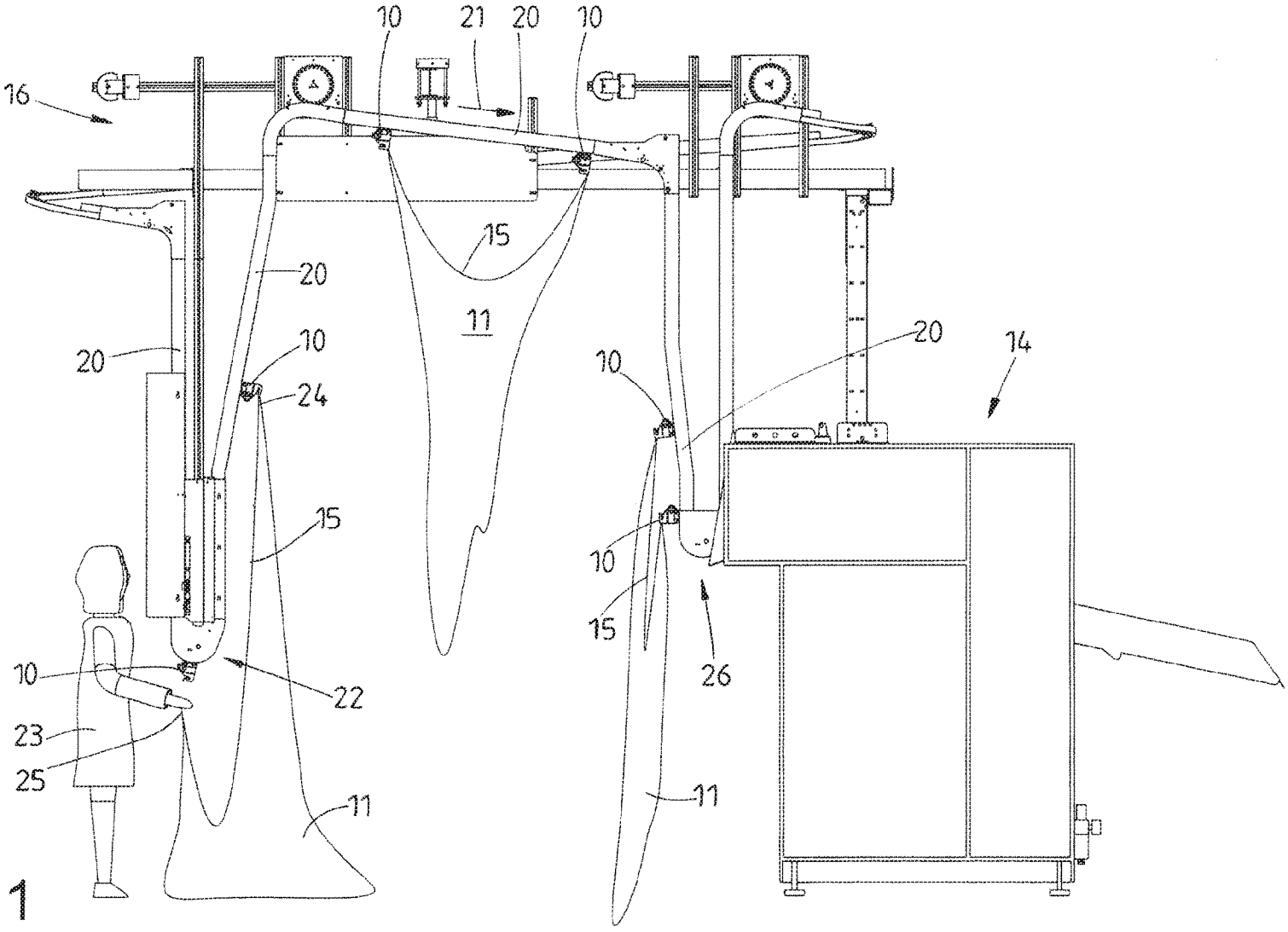
FIG. 1 shows a schematic side view of a device according to the invention.

The device shown in the figures is preferably employed in commercial laundries. The device serves to transport laundry items 11, each hanging on two successive clamps 10, in each case to two spreading clamps 12 of a pair of spreading clamps of a spreading device 13 of an input machine 14 and to transfer them to the spreading clamps 12 of the respective pair of spreading clamps. The laundry item 11 is then spread by the spreading clamps 12 and fed in the spread state and with a leading front edge 15 to a mangle or some other laundry treatment device.

Figure 2:
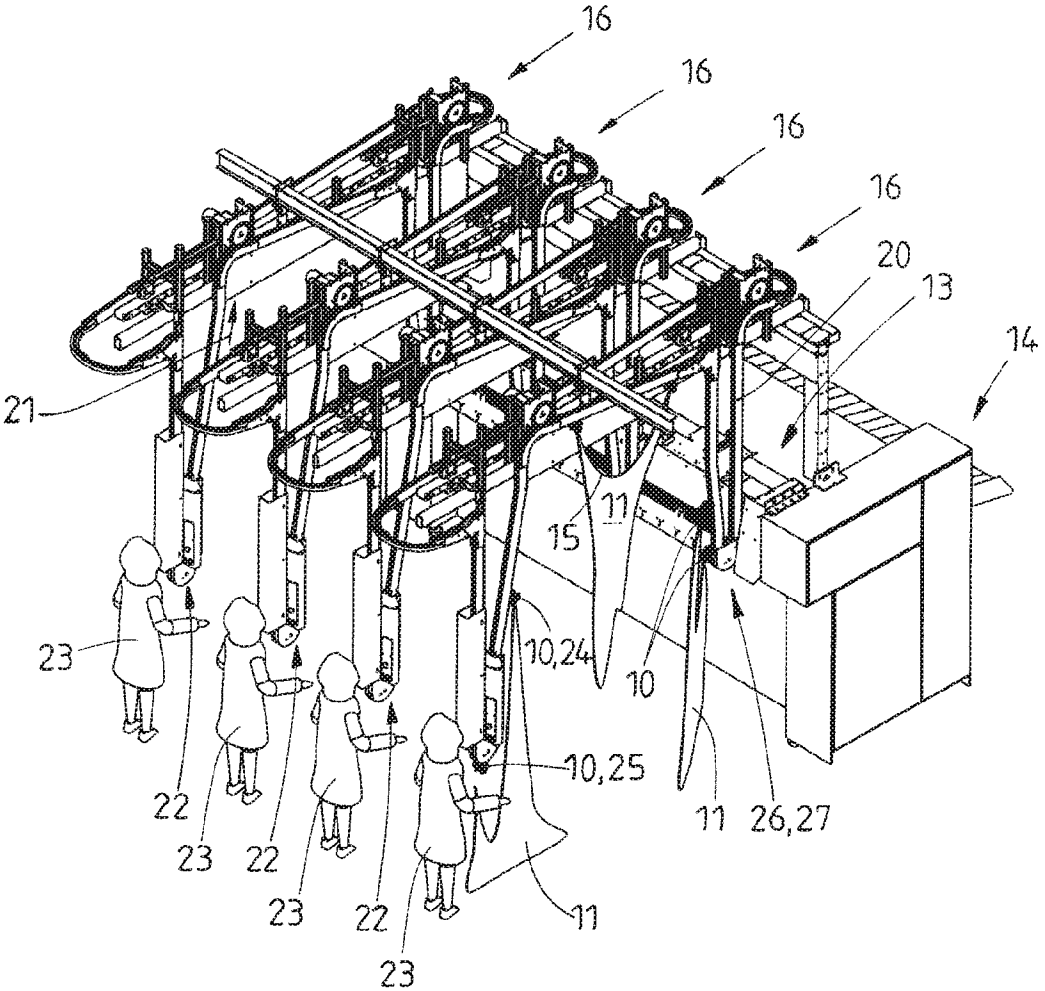
FIG. 2 shows a general perspective view of the device.
Figure 3:
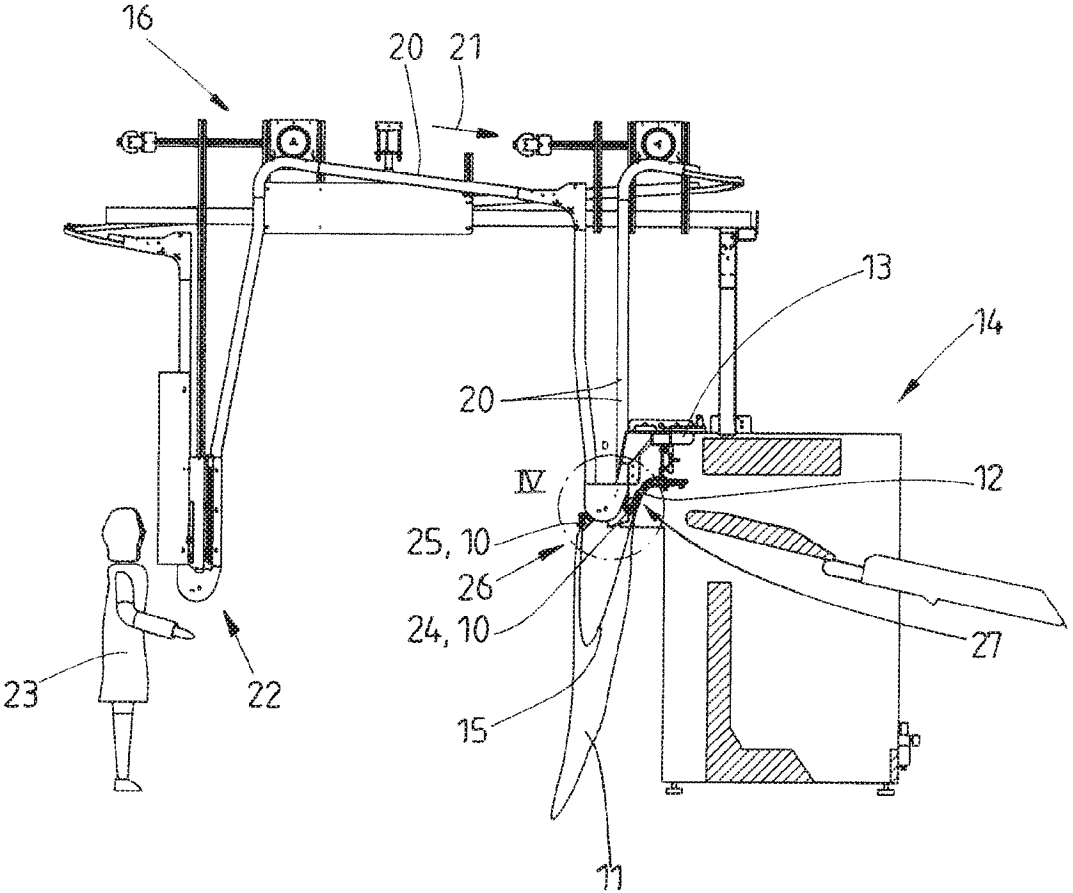
FIG. 3 shows a side view of the device analogous to FIG. 1 in a transfer position of one conveyor clamp in the region of a spreading clamp of an input machine.

The device has at least one conveyor 16. FIG. 2 shows the device with four identical conveyors 16 arranged side by side. All four conveyors 16 are located upstream of the single input machine 14. However, the invention is not restricted to four conveyors 16. Rather, the invention also relates to devices having only a single conveyor 16 or a larger or smaller number than four adjacent conveyors 16 upstream of the input machine 14.

The input machine 14 for spreading the respective laundry item 11 and feeding the same in a spread state to a following mangle, for example, is also a component of the device. However, the invention is not limited to devices having an input machine 14 and at least one conveyor upstream thereof. Rather, the device can also comprise only at least one conveyor 16.

Figure 4:
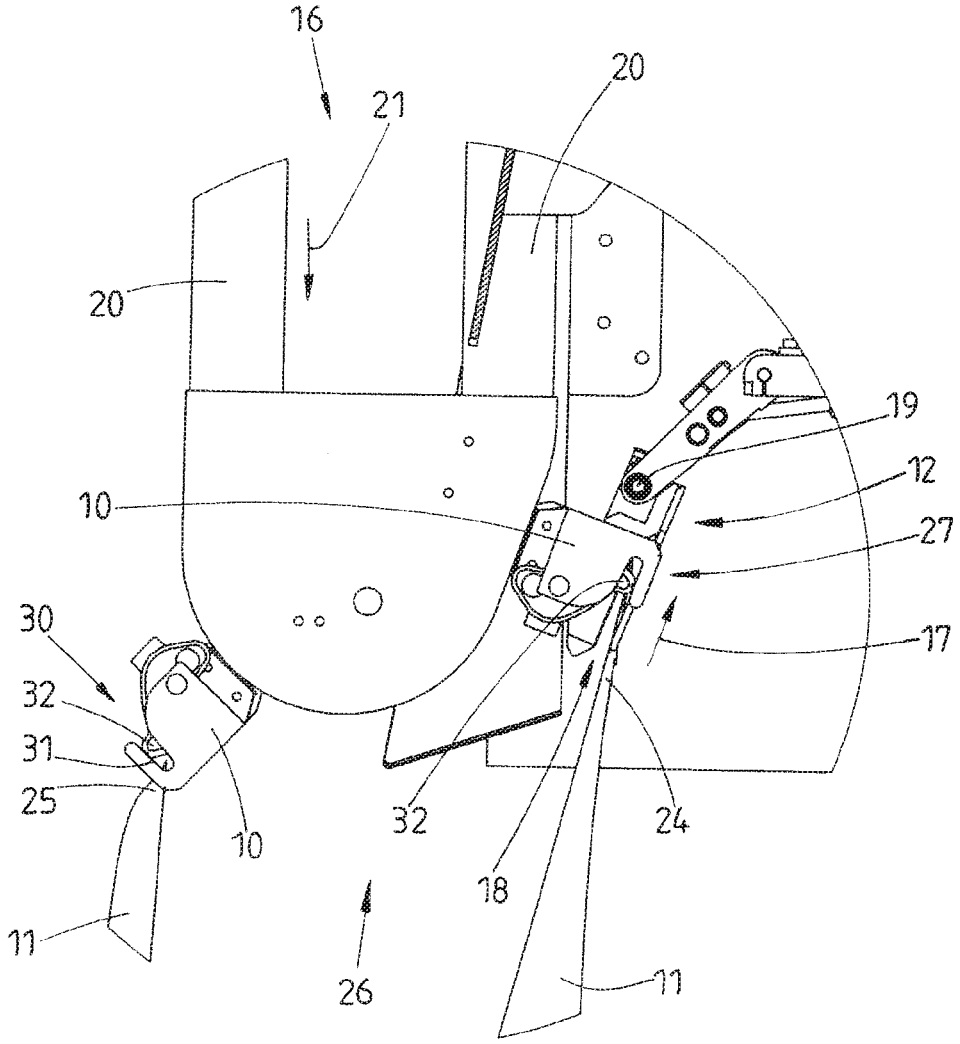
FIG. 4 shows an enlarged detail IV from FIG. 3.

The spreading device 13 of the input machine 14 extends transversely to the feed direction 17 of the spread laundry items 11 from the input machine 14 to a downstream mangle or some other type of laundry treatment device. The transversely directed spreading device 13 has at least one pair of spreading clamps with two spreading clamps 12 which can be moved together and apart from one another. The traveling path of the spreading clamps 12 runs transversely to the feed direction 17 of the input machine. Each of the identically configured spreading clamps 12 has one clamping mouth 18 open at the bottom or at the side. The spreading clamps 12 of the spreading device 13 can be pivoted about a pivot axis 19 running parallel to their traveling direction. This pivot axis 19 thus extends also transversely to the feed direction 17 (FIG. 4). In the following, one of the identical, namely parallel conveyors 16 of the device is described in more detail:

The conveyor 16 has a track 20 which defines the transport path, on or in which a plurality of spaced-apart, consecutive and preferably identical clamps 10 can travel, for example by means of a carriage which carries the respective clamp 10. The track 20, at least in sections thereof, is assigned a circulating driven transport segment by means of which the clamps 10 can be driven in the transport direction 21 along the track 20 or at least along certain sections of the 20.

In the figures, in particular FIG. 1, three pairs of clamps are shown only by way of example. In actual fact, the conveyor 16 has a greater number of consecutive clamps 10. The course and length of the track 20 of the conveyor 16 can also be substantially larger and deviate from the representation shown in the figures. For that reason, the mere six clamps 10 and three laundry items 11 shown in FIG. 1 should be understood only as an illustrative example and not that the invention is to be restricted to this arrangement.

At a loading station 22 of the respective conveyor 16, an operator 23 inserts in each case a single laundry item 11 into the clamps 10. In the case of this device, this is carried out by hanging the respective laundry item 11 with the two opposite corners 24, 25 or corner regions of its front edge 15 one after the other into two consecutive and spaced-apart clamps 10.

Each laundry item 11 hanging on two consecutive clamps 10 is then transported along the track 20 of the conveyor 16 to the input machine 14. Here the conveyor 16, by means of a correspondingly long track 20, can also serve as a store or buffer stock for a number of laundry items 11 to be held in waiting for transfer from the clamps 10 to the spreading clamps 12 of the input machine 14.

The adjacent corners 24, 25 of the front edge 15 of the respective laundry item 11 are transferred automatically to the spreading clamps 12 of the input machine 14 one after the other. This occurs in the region of an unloading station 26 of the respective conveyor 16. The single, unbranched track 20 of the respective conveyor 16 leads to the input machine 14 in such a manner that the corners 24, 25 of a laundry item 11 can be transferred one after the other or successively from the clamps 10 of the conveyor 16 to a specific position 27, namely a transfer point, initially to a first spreading clamp 12 of the pair of spreading clamps and subsequently to a second spreading clamp 12 of the same pair of spreading clamps. This position 27 corresponds to the positioning of the track 20 of the conveyor 16 in the region of the unloading station 26 upstream of the input machine 14. In the case of the device shown in FIG. 2 with four parallel and identical conveyors 16, there are therefore four adjacent off-center positions 27 corresponding to the spacing of the conveyors 16 provided in front of the spreading device 13 of the input machine 14. At each position 27 a laundry item 11 is transferred to the spreading clamps 12 by the successive transfer of its corners 24, 25 from the conveyor 16 located at the respective position 27.

Figure 5:
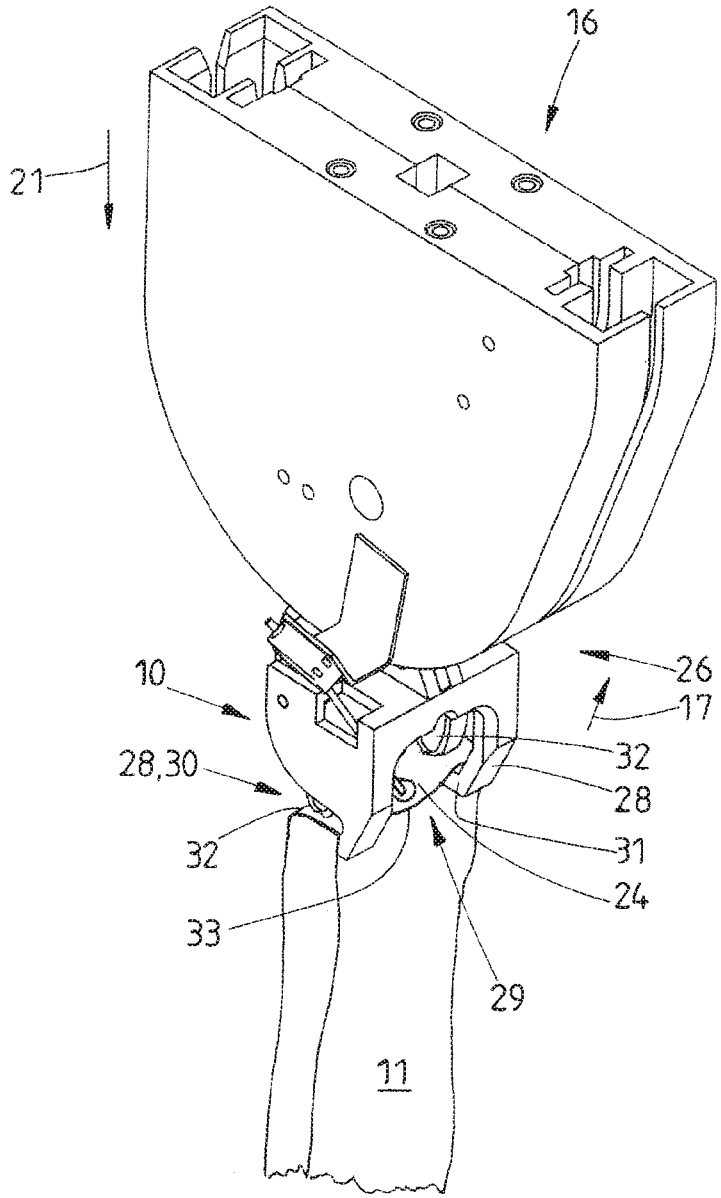
FIG. 5 shows a perspective view of a lower deflection part of the conveyor with a conveyor clamp holding a corner of a laundry item.

FIG. 5 in particular shows the unloading station 26 of a conveyor 16 having a clamp 10, which holds a corner 24 of a laundry item 11, located at the lower deflection point of the unloading station 26. This clamp 10 is configured just like all other clamps 10 of each conveyor 16 in the manner of a double clamp with two spaced-apart, preferably identically configured individual clamps 28. A space 29 is located between the spaced-apart clamps 28. The distance between the two individual clamps 28 of each clamp 10 configured as a double clamp, i.e. the width of the space 29, is larger, at least somewhat larger, than the width of the respective spreading clamp 12. The spreading clamp 13 can therefore pass through the space 29 during the transfer of the corner 24, 25 of the laundry item 11 from the clamp 10 of the respective conveyor 16 and the spaced-apart individual clamps 28 of the clamp 10 can run past the respective spreading clamp 12 on opposite sides thereof.

The two spaced-apart individual clamps 28 of each clamp 10 configured as a double clamp have a clamping mouth 30 that is open on one side. Said clamping mouth 30 is delimited on its underside by a fixed contact surface 31. Provided on the opposite side of the clamping mouth 30 is a movable clamping tongue 32. When the latter is moved away from the contact surface 31, the corner 24, 25 of the laundry item 10 held in the clamping mouths 30 can be released from the respective clamp 10 configured as a double clamp. An open side of the clamping mouth 30 of each of the two individual clamps 28 of the clamp 10 is directed upstream as seen in the transport direction 21, in other words away from the transport direction 21, of the conveyor 16. Accordingly, the open end of each clamping mouth 30 is followed in the direction of transport 21 by a closed end of the respective clamping mouth 30 (FIG. 4). In other words, the open end of each clamping mouth 30 is assigned to the end of the same which lags behind in the direction of transport 21.

The method according to the invention is described in the following in conjunction with a conveyor 16 of the previously described device:

At the loading station 22 of the respective conveyor 16 an operator 23 first inserts the first corner 24 into a clamp 10 and then the adjacent corner 25 of the laundry item into the clamp 10 of the conveyor 16 which follows at a distance. The laundry item 10 then hangs with the adjacent corners 24, 25 of the front edge 15 from the spaced-apart and consecutive clamps 10 of the conveyor 16.

The laundry item 11 hung up at the loading station 22 into consecutive clamps 10 with adjacent corners 24, 25 is now transported by the respective conveyor 16 along the transport direction 21 to the unloading station 26 upstream of the spreading device 13 of the input machine 14.

The two spreading clamps 12 of a pair of spreading clamps are driven one by one to the position 27 where adjacent corners 24, 25 of the front edge 15 of the laundry item 11 are transferred and/or taken over one after the other from the consecutive clamps 10 of the respective conveyor 16.

It is conceivable that the distance between the two clamps 10 respectively holding one of the adjacent corners 24, 25 of a laundry item 11 changes during the course of the track 20 of the conveyor 16. For example, the distance between the clamps 10 holding the adjacent corners 24, 25 of a laundry item 11 will be reduced in a section of the track 20 that is horizontal or slightly tilted with respect to the horizontal in the transport direction 21 in order to allow for a buffer of a plurality of successive laundry items, in particular in this section of the track 20. In the shown exemplary embodiment, the distance between the two clamps 10 each holding a laundry item 11 at its corners 24, 25 is likewise reduced shortly before the unloading station 26. Nevertheless, there always remains a sufficient distance between the clamps 10 each holding a laundry item 11 at its corners 24, 25.

The unloading station 26 of the respective conveyor 16 is led to the input machine 14 at a single position 27 of the respective conveyor 16, specifically as seen in the feed-in direction 17 at or in front of the spreading device 13. In the case involving a plurality of parallel and preferably identical conveyors 16, as indicated in FIG. 2, for example, each conveyor 16 leads to the spreading device 13 of the input machine 14 at a single position 27 of its own. The transfer of the adjacent corners 24, 25 of the front edge 25 of the respective laundry item 11 to the spreading clamps 12 of the input machine 14 is executed in succession on a single track at the single position 27, namely the unloading position at the unloading station 26, of the respective conveyor 16.

The respective laundry item 11 is first transferred from the clamps 10 with the one corner 24 to a first spreading clamp 12 of the respective pair of spreading clamps of the spreading device 13. Subsequently, at the same position 27, the adjacent second corner 25 of the front edge 15 of the same laundry item 11 is transferred to the second spreading clamp 12 of the pair of spreading clamps.

In order that the corners 24, 25 of the front edge 15 of the respective laundry item 11 can be transferred one after another on a single track from the respective conveyor 16 at the same position 27, the transfer of the first corner 24 to the first spreading clamp 12 of the respective pair of spreading clamps is followed by this now loaded spreading clamp 12 being driven away from the position 27 in order to make room for the second spreading clamp 12 of the respective pair of spreading clamps, which is subsequently driven to the same position 27 so that it can then receive from the following clamp 10 of the conveyor 16 the second corner 25 of the front edge 15 of the laundry item 11 held by the latter.

As a result of the respective clamp 10 being realized as a double clamp having a space 29 between the two spaced-apart individual clamps 28, the respective edges 24, 25 of the laundry item 11 can be transferred from the clamps 10 to the spreading clamps 12 in a fluent manner. In particular, transfer is executed as the clamps 10 holding the respective corner 24, 25 to be transferred travel past the spreading clamp 12 that has momentarily been driven to the provided position 27. The respective spreading clamp 12 has only a single clamp with a width that is slightly less than the space 29 between the individual clamps 28 of the clamp 10 configured as a double clamp 10. As a result, the respective clamp 10 can travel in the feed-in direction past the spreading clamp 12, which has been stopped and is now waiting at the position 27, in that the individual clamps 28 of the clamp 10 pass by, so to speak, the spreading clamp 12 on opposite sides thereof. The fluent or "on the fly" transfer of a respective corner 24, 25 of a laundry item 10 to a spreading clamp 12 is thereby carried out during the continuous, uninterrupted further transport of the clamps 10 on the track 20 of the respective conveyor 16. A section 33 of the respective corner 24, 25, which is exposed in a stretched state in the space 29 between the two spaced-apart individual clamps 28 of the respective clamp 10, is driven or inserted into the clamping mouth 18, which is open at the front, of the spreading clamp 12, which is momentarily located at position 27.

The process of transferring a laundry item 11 to the two spreading clamps 12 of a spreading clamp pair thus comprises two identical transfer procedures carried out one after the other and executed at the same position 27 of the spreading device 13 of the input machine 14. Here the front corner 24 of the laundry item 11 as seen in the transport direction 21 or in the feed-in direction 17 is first transferred at position 27 from the clamp 10 holding it to the first spreading clamp 12 and subsequently, when the second spreading clamp 12 of the pair of spreading clamps has been driven to position 27, the following second corner 25 of the laundry item 11 is transferred to the second spreading clamp 12 of the pair of spreading clamps.

The described process for transferring the laundry item 10 to the spreading device 13 is executed in a continuous manner with respect to the motion of the clamps 10 of the respective conveyor 16. However, the spreading clamps 12 are driven in a non-continuous manner, namely bit by bit, at least for the transfer of the respective laundry item 11 from the conveyor at the same and singular position 27, and briefly stopped at this point during the transfer procedure associated with the respective conveyor 16.

The procedure described above is carried out in principle in exactly the same manner at the other conveyors 16. Laundry items 11 are merely transferred one after the other by the individual conveyors 16 to the spreading clamps 12 of the input machine 14 at the singular position 27 assigned to the respective conveyor 16. In the case of spreading devices 13 with a plurality of spreading clamp pairs, laundry items 11 can be transferred simultaneously to spreading clamps 12 of different pairs of spreading clamps by a plurality of conveyors 16 at position 27 respectively assigned to each conveyor and differing from the other positions.

As an alternative, it is conceivable that the clamps 10 are moved onwards by the conveyor 16 in a non-continuous manner. For example, it can be provided that, after the first corner 24 of the front edge 15 of the laundry item 11 has been transferred to the first spreading clamp 12 of the respective pair of spreading clamps, the following clamp 10, which holds the second corner 25 of the front edge 15, is temporarily stopped. By so doing, there is, if necessary, enough time for the spreading device 13 to drive the second spreading clamp 12 of the pair of spreading clamps to the position 27 where, following the transfer of the first corner 24, the second corner 25 is also to be transferred to the second spreading clamp 12.

LIST OF DESIGNATIONS

10 clamp
11 laundry item

12 spreading clamp
13 spreading device
14 input machine
15 front edge
16 conveyor
17 feed-in direction
18 clamping mouth
19 pivot axis
20 track
21 transport direction
22 loading station
23 operator
24 corner
25 corner
26 unloading station
27 position
28 individual clamp
29 space
30 clamping mouth
31 contact surface
32 clamping tongue
33 section

What is claimed is:

1. A method for the transport and/or the spreading of laundry items hanging on clamps, preferably for the purpose of transferring the laundry items to an input machine, wherein the respective laundry item hanging with adjacent corners of an edge in clamps of at least one conveyor is transferred to two spreading clamps of a spreading device of the input machine, comprising:

transferring the adjacent corners of the laundry item concerned one after the other from the clamps to the two spreading clamps of the spreading device, wherein the transfer of the laundry items from consecutive clamps of the respective conveyor to the spreading clamps is performed in a successive bit by bit manner, and wherein the respective laundry item is transferred to the two spreading clamps of a pair of spreading clamps by such successive or consecutive clamps of the respective conveyor which hold the adjacent corners of the edge of the laundry item.

2. The method as claimed in claim 1, wherein the clamps of the respective conveyor transfer the adjacent corners of the edge of the laundry item delimited by said clamps one after another or in succession to the two spreading clamps of the respective pair of spreading clamps at the same position, wherein the two spreading clamps are driven in alternation to this position for the successive transfer of the respective corner from the clamps of the respective conveyor, which are driven one after another to the position, to the spreading clamps of the respective pair of spreading clamps, which spreading clamps are likewise driven one after another to the position.

3. The method as claimed in claim 2, wherein the corner is transferred to the respective waiting spreading clamp of the pair of spreading clamps as the clamps of the respective conveyor, which hold the one corner of the laundry item concerned, pass by a spreading clamp of the input machine, which spreading clamp has been driven to the position of transfer as the clamps, with the corners of the laundry item concerned located therein, pass by the spreading clamps which have momentarily stopped at the position.

4. A device for the transport and/or the spreading of laundry items hanging on clamps, preferably for the purpose of transporting laundry items hanging on clamps to an input machine, comprising:

at least one conveyor, which has at least one circulating track running along its conveying section, on which run successive clamps, each for one corner of the laundry item concerned, wherein the at least one track is led to the input machine for transferring adjacent corners of an edge of the respective laundry item to spreading clamps of at least one pair of spreading clamps of the input machine, wherein the clamps assigned one after another to the track are configured to hold adjacent corners of the edge of the laundry item, and are driven in succession along a respective spreading clamp of the pair of spreading clamps.

5. The device as claimed in claim 4, wherein the clamps of the respective conveyor are driven one by one along and/or past the same position of the input machine, in each case along and/or or past spreading clamps of least one pair of spreading clamps of a spreading device of the input machine which are held ready at the same position.

6. The device as claimed in claim 5, wherein all clamps of the respective conveyor are equally configured as double clamps with two spaced-apart individual clamps for jointly holding a corner of the respective laundry item.

7. The device as claimed in claim 6, wherein an inner distance of the two individual clamps of each clamp or double clamp is somewhat larger than a width of the respective spreading clamp of the spreading device.

8. The device as claimed in claim 4, wherein the track of the respective conveyor is realized as a single track or single line, along its entire course, and/or the track of the respective conveyor is led to the spreading device of the input machine in such a manner that a section of the respective corner of the laundry item held in a stretched manner between the individual clamps of the respective clamps of the conveyor concerned are transported into an open end of a clamping mouth of the respective spreading clamp by the respective conveyor.

* * * * *